United States Patent [19]

Ahlgren

[11] 3,945,169

[45] Mar. 23, 1976

[54] FRAMEWORK STRUCTURES

[76] Inventor: Nils Harald Ahlgren, Skyttevagen 22, 133 00 Saltsjobaden, Sweden

[22] Filed: Jan. 23, 1975

[21] Appl. No.: 543,363

Related U.S. Application Data

[62] Division of Ser. No. 354,926, April 27, 1973, abandoned.

[52] U.S. Cl. ..... 52/741; 52/122

[51] Int. Cl.[2] ..... E04B 1/00

[58] Field of Search ..... 52/126, 744, 122

[56] References Cited

UNITED STATES PATENTS

| | | | |
|---|---|---|---|
| 1,819,031 | 8/1931 | Kuhlman | 52/645 |
| 2,303,428 | 12/1942 | Black | 52/645 |
| 2,854,261 | 9/1958 | Spaide | 403/53 |
| 3,028,928 | 4/1962 | Juculano | 182/178 |
| 3,092,407 | 6/1963 | Blonder | 52/638 X |
| 3,190,405 | 6/1965 | Squire | 52/637 |

*Primary Examiner*—Frank L. Abbott
*Assistant Examiner*—Carl D. Friedman

[57] ABSTRACT

A framework structure comprises longitudinal load-bearing elements and bracing elements interconnecting the load-bearing elements and intended to rigidify the structure and take up transverse forces. To this end the fastening of the bracing elements to the longitudinal elements is realized at least on one side of the structure by connections permitting a certain relative movement between the bracing elements and the longitudinal elements longitudinally of the structure.

In such a framework structure as comprises longitudinal load-bearing elements and bracing elements interconnecting said load-bearing elements and serving to rigidify the structure and to take up transverse forces, the ends of the longitudinal load-bearing elements cooperate with jacks to compensate arising displacements.

7 Claims, 9 Drawing Figures

FIG. 1
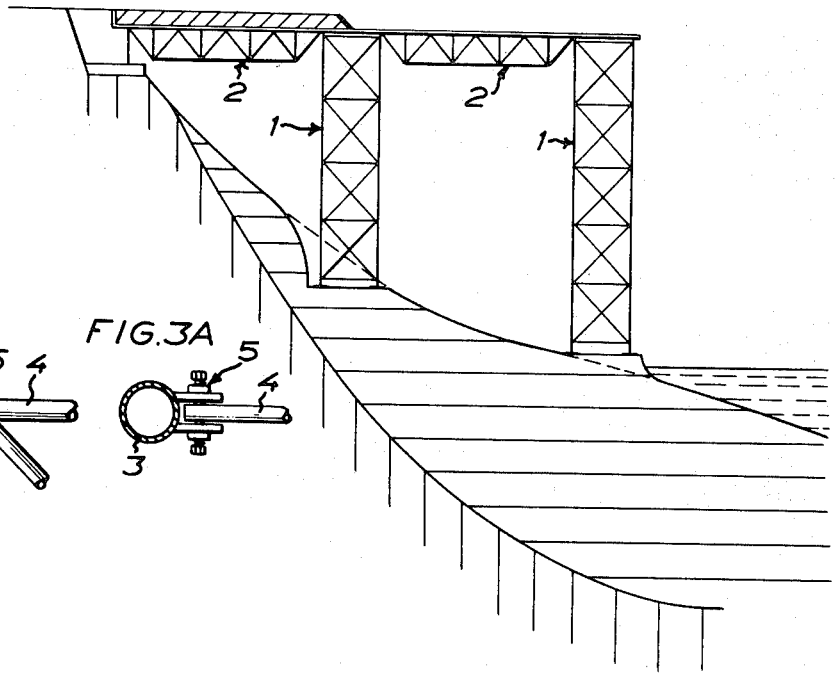
FIG. 3
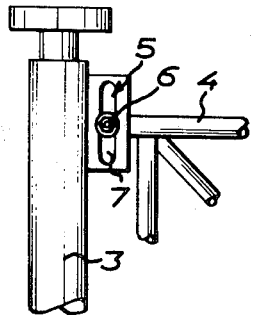
FIG. 3A
FIG. 4
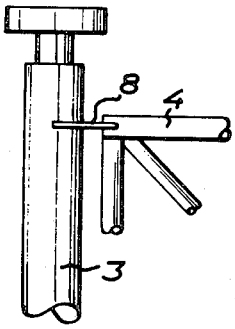
FIG. 4A
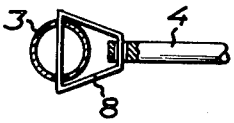
FIG. 2
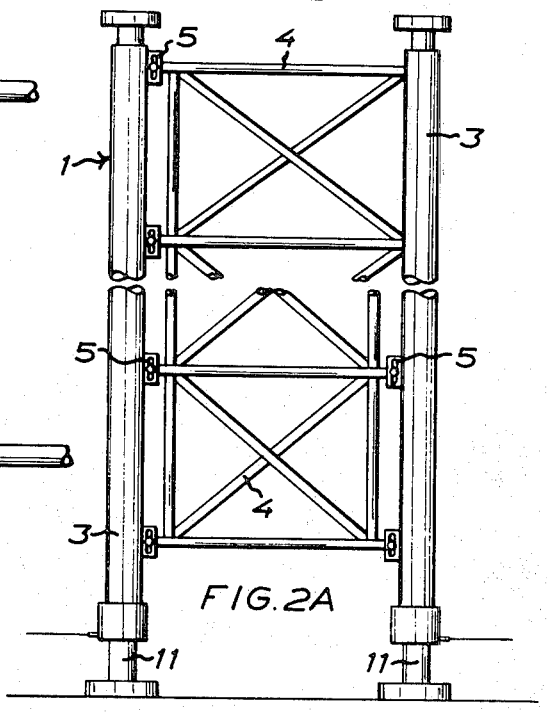
FIG. 2A
FIG. 5
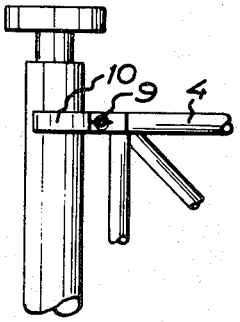
FIG. 5A
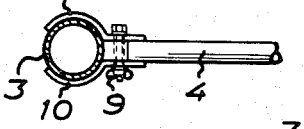

FRAMEWORK STRUCTURES

This is a division of application Ser. No. 354,926 filed Apr. 27, 1973, now abandoned.

Frameworks comprising scaffold towers with intermediary form beams are utilized to support the formwork for concrete bridges. To save labour costs there is a trend towards ever larger units, that is, the towers are constructed for larger concentrated loads and are spaced longer distances apart, whereby the beams will have to be given longer spans.

Under the load of the supplied concrete the form beams may be subject to deflection and thus cause crack formation in the fresh concrete, whereby limits are set to the spans of the form beams. For this reason as well as for economical reasons it is desired to support the form beams on the side edges of the scaffold towers instead of extending them so much that they reach to the centre lines of the towers, which would result in a more suitable loading of the towers.

When the concrete load is supplied starting from one side the scaffold towers will temporarily be under full load on the load-bearing vertical supporting elements of one side only. The vertical supporting elements of that side will therefore be elastically compressed and vertically displaced in relation to the vertical supporting elements of the non-loaded side, and if the subgrade is yieldable there will be an increased displacement. Moreover, in such scaffold constructions it often happens that the subgrade consists of layers of varying loadbearing capacity and thickness and that the layer thicknesses and the properties of the subgrade material are changed by excavation or back filling.

When the supporting elements on one side of the scaffold tower are displaced relative to those on the other side there arise large forces in the bracing elements connecting the sides of the scaffold tower. These bracing elements are normally dimensioned so as to take up wind loads and to reduce the effective length (i.e., unsupported length over which buckling occurs) of the vertical supporting elements by fixation of the positions of the junctions. These dimensioning forces are considerably smaller than those arising in the bracing elements upon relative displacement of the supporting elements. If on dimensioning the bracing elements no attention is paid to these forces these elements may be put under excess load so that rupture occurs and the measures taken to prevent buckling will cease in effect, from which a total collapse of the scaffold tower follows.

The present invention has for its object to permit a vertical supporting element to be displaced relative to one or more other supporting elements in the same scaffold tower without inadmissibly great forces being formed in the bracing elements. This is realized in that the bracing elements are fastened to the vertical supporting elements at least on one side of the tower by means of connections allowing a certain relative movement to occur between the bracing elements and the vertical supporting elements in the vertical direction.

The connection may be in the form of a bolt which can move in vertical direction in an oblong hole, and the movement can be controlled and the displacing forces regulated by means of spring-loaded washers which slide on surfaces displaced relative to said washers. By this arrangement the scaffold tower under normal wind loads will function as a rigid unit without displacement in the junctions, in which unit, however, displacement will take place without risk of excess loading of the bracing elements when the displacing force becomes greater than the force for which the supporting elements have been dimensioned.

The connection between the bracing elements and the vertical supporting elements can also be realized with the aid of yoke means, guide means or the like.

The invention also relates to a framework structure comprising longitudinal load-bearing elements and bracing elements interconnecting said longitudinal load-bearing elements and serving to rigidify the structure and to take up transverse forces. According to the invention, the ends of the longitudinal load-bearing elements are arranged to coact with jacks to compensate arising displacements.

The invention will be more fully described hereinbelow with reference to the accompanying drawing which shows a pair of framework towers, chosen by way of example, as well as some embodiments of the connection between the bracing elements and the vertical load-bearing supporting elements.

In the drawing:

FIG. 1 shows a bridge under construction with the use of framework towers according to the invention;

FIG. 2 is an elevation of one embodiment of the framework tower;

FIG. 2A is an elevation of another embodiment of the framework tower;

FIGS. 3 and 3A on a larger scale show the connection between the bracing elements and the vertical load-bearing supporting elements in the two embodiments according to FIGS. 2 and 2A;

FIGS. 4 and 4A show another embodiment of the connection between the bracing elements and the vertical load-bearing supporting elements;

FIGS. 5 and 5A show a further embodiment of the connection between said elements.

1 designates two scaffold towers for the concrete bridge which is cast from one direction, i.e., from the pier. The scaffold towers 1 are provided with intermediary form beams 2 which are placed on the side edges of the scaffold towers 1, and these side edges thus serve as vertical loadbearing supporting elements 3. The supporting elements 3 at both sides are interconnected by bracing elements 4 serving to rigidify the structure and to take up transverse forces.

As shown in FIG. 2, the bracing elements 4 are fastened to the supporting elements 3 on one side of the structure by means of connections 5 allowing a certain relative movement between said bracing elements 4 and said supporting elements 3 longitudinally of the structure. On the other side of the structure the bracing elements 4 are rigidly fastened to the supporting elements 3.

As shown in FIG. 2A, the fastening of the bracing elements 4 to the supporting elements 3 on the two sides of the structure is realized by connections 5 which allow the contemplated relative movement.

In the drawing, the bracing arrangement has been shown only in one plane since it normally is the same on all sides of the structure. As a rule, the framework structure is thus composed of elements which can be incorporated with the structure on any side thereof whatever. Thus, all supporting elements 3 in the embodiment shown in FIG. 2 are provided with but one series of connections 5, whereas all supporting elements 3 in the embodiment shown in FIG. 2A are provided with two series of connections 5.

As will best appear from FIGS. 3 and 3A, the connection 5 has been formed as a bolt 6 which moves in a vertical direction in an oblong hole 7, said movement being controlled and the displacing force regulated by means of spring-loaded washers which slide against surfaces displaced relative to said washers.

The connection shown in FIGS. 4 and 4A, which allows the contemplated relative movement, is formed by the yoke member 8 which is pivoted both to the supporting element 3 and to the bracing element 4. As shown in FIGS. 5, 5A the connection is composed of a pair of gripping jaws 10 which are engageable with the supporting element 3 with the aid of the screwed device 9 and are disposed on the bracing element 4. The gripping jaws thus serve as frictional connector members.

As will appear from FIGS. 2 and 2A, the lower ends of the vertical load-bearing supporting elements 3 are arranged to cooperate with preferably hydraulic jacks 11 to compensate arising displacements. Especially when the fastening of the bracing elements 4 to the vertical loadbearing supporting elements 3 is realized by connections allowing a certain relative movement between the bracing elements 4 and the supporting elements 3 longitudinally of the structure, the jacks 11 shall be actuable individually or in groups to compensate arising displacement without generating forces in the bracing elements 4. Upon actuation of the jacks 11 it may be suitable to reduce or wholly cancel the frictional force in the connections that shall temporarily allow a relative movement between the bracing element 4 and the vertical supporting element 3.

I claim:

1. A method of adjusting the relative position of longitudinal load-bearing elements and transverse bracing elements connected thereto of a framework structure when the framework structure is under load, and when the load is eccentrically applied to said framework structure; where said framework structure comprises a plurality of spaced-aparat longitudinal load-bearing elements and transverse bracing elements interconnecting said longitudinal elements and serving to rigidify the structure and to take up transverse forces, said transverse bracing elements being connected to the longitudinal load-bearing elements on at least one side of the framework structure by connector means which permit relative longitudinal movement to occur between said transverse bracing elements and said longitudinal load-bearing elements on said at least one side of said framework structure; each of said transverse bracing elements comprising more than one elongate structural member and having such geometrical configuration so that said elongate structural members are secured in a geometrical configuration to retain the spaced-apart longitudinal load-bearing elements at a predetermined spaced-apart distance relative to each other;

said method comprising the steps of:

a. affixing said connector means between said transverse bracing elements and the longitudinal load-bearing elements to said longitudinal load-bearing elements on said at least one side of said framework structure in such a manner that relative longitudinal movement of between any said longitudinal load-bearing element and the transverse bracing elements connected thereto is allowed to occur only after a predetermined force caused by said connector means is overcome; and b. applying load to at least one longitudinal load-bearing element of said framework structure so that said load is applied eccentrically to said framework structure, the force of said applied load being of a greater magnitude than said predetermined force caused by said connector which is required to be overcome, so as to allow relative longitudinal movement between said at least one longitudinal load-bearing element to which said load is applied and the transverse bracing elements connected thereto.

2. The method of claim 1 when said connector means are secured to said longitudinal load-bearing elements and have oblong holes formed therein and spring-loaded fastening means passed therethrough, so as to permit relative longitudinal movement between said longitudinal load-bearing elements and said transverse bracing elements.

3. The method of claim 1 when said connected means comprise sliding means disposed on and engaging said longitudinal load-bearing elements and secured to said transverse bracing elements.

4. The method of claim 1 when load is applied axially to each said longitudinal load-bearing element at a first end thereof, and where there is a jack means disposed at the end of at least one of said longitudinal load-bearing members remote from said first end thereof, whereby said relative position of said longitudinal load bearing element to said transverse bracing elements may be adjusted in a direction opposite to that in which said load is applied.

5. The method of claim 4 where a plurality of jacks are disposed, one at the end of each of said longitudinal load-bearing members at the end of each thereof remote from said first end.

6. The method of claim 5 when said plurality of jacks are individually operable.

7. The method of claim 5 when said plurality of jacks are operable in at least one group thereof.

* * * * *